US005282664A

United States Patent [19]

Tseng

[11] Patent Number: 5,282,664

[45] Date of Patent: Feb. 1, 1994

[54] FOLDING LAWN CHAIR

[76] Inventor: Chun-Chu Tseng, No. 3, Ting-Hsi-Hsin, Lu-Man Ts'un, Chu-Chi Hsiàng Chiayi Hsien, Taiwan

[21] Appl. No.: 76,533

[22] Filed: Jun. 14, 1993

Related U.S. Application Data

[63] Continuation-in-part of Ser. No. 939,301, Sep. 2, 1992, Pat. No. 5,244,249.

[51] Int. Cl.[5] ..... A47C 4/00

[52] U.S. Cl. ..... 297/31; 297/28; 297/378.12

[58] Field of Search ..... 297/27, 28, 31, 378.12

[56] References Cited

U.S. PATENT DOCUMENTS

| | | | |
|---|---|---|---|
| 155,758 | 10/1874 | Schlientz | 297/28 |
| 383,058 | 5/1888 | Kree | 297/28 |
| 795,188 | 7/1905 | Barratt | 297/19 |
| 1,404,449 | 1/1922 | Laham | 297/19 |
| 2,177,186 | 10/1939 | Nordmark | 297/58 |
| 2,195,461 | 4/1940 | Koenig | 297/31 |
| 2,207,338 | 7/1940 | Clarin | 297/58 |
| 2,211,289 | 8/1940 | Orton | 297/58 |
| 3,032,373 | 5/1962 | Dauciart et al. | 297/378.12 X |
| 4,003,599 | 1/1977 | Takamatsu | 297/391 X |
| 4,014,591 | 3/1977 | Gittings | 297/55 |
| 4,906,042 | 3/1990 | Ollat | 297/19 |
| 5,154,477 | 10/1992 | Lacy | 297/DIG. 6 X |

FOREIGN PATENT DOCUMENTS

| | | | |
|---|---|---|---|
| 30275 | 10/1907 | Austria | 297/23 |
| 207522 | 2/1960 | Austria | 297/19 |
| 1029849 | 6/1953 | France | 297/28 |
| 2317894 | 2/1977 | France | 297/19 |
| 3831 | of 1880 | United Kingdom | 297/28 |
| 13596 | of 1908 | United Kingdom | 297/23 |

*Primary Examiner*—Lloyd A. Gall

*Attorney, Agent, or Firm*—Willian Brinks Hofer Gilson & Lione

[57] ABSTRACT

A lawn chair includes a seat frame assembly which has a seat frame and a rear leg frame, a backrest frame connected pivotally to the rear end portion of the seat frame at the lower end portion thereof, two spaced arm supporting frames provided on two sides of the backrest frame, two elongated positioning members secured to the rear end portions of the arm supporting frames, and two positioning studs extending outwardly from the two sides of the backrest frame. Each of the arm supporting frames has an intermediate portion connected pivotally to the seat frame, a front leg portion extending downwardly and forwardly from the intermediate portion, and an armrest portion extending upwardly and rearwardly from the intermediate portion. Each positioning member has an access hole and a longitudinal slot communicating with the access hole and having a horizontal row of upwardly extending positioning portions. Each of the studs engages a selected one of the positioning portions of the longitudinal slot and has a neck that is sized to prevent removal thereof from the longitudinal slot and to be slidable from the longitudinal slot into the access hole, and an enlarged head that is sized to be extensible through the access hole when the corresponding neck is moved to the same.

1 Claim, 4 Drawing Sheets

FOLDING LAWN CHAIR

CROSS-REFERENCE OF RELATED APPLICATION

This invention is a continuation-in-part of U.S. patent application Ser. No. 07/939,301, filed on Sep. 2, 1992, U.S. Pat. No. 5,244,249.

BACKGROUND OF THE INVENTION

1. Field of the Invention

This invention relates to a lawn chair, more particularly to a lawn chair which can be folded when not in use.

2. Description of the Related Art

Although the angle between the backrest and the seat of the lawn chair of the parent application, i.e. U.S. patent application Ser. No. 07/939,301, can be adjusted, the lawn chair of the parent application cannot be folded. Thus, a relatively large storage space is required when the lawn chair is not in use.

SUMMARY OF THE INVENTION

Therefore, the main object of this invention is to provide a lawn chair that can be folded when not in use so as to reduce the storage space which is required by the same.

According to this invention, a lawn chair includes a backrest frame, a seat frame assembly, two spaced arm supporting frames, two elongated positioning members and two opposed positioning studs. The seat frame assembly includes a seat frame and a rear leg frame which has an upper end portion formed integrally with the rear end portion of the seat frame. The backrest frame is connected pivotally to the rear end portion of the seat frame at the lower end portion thereof. The arm supporting frames are provided on two opposite sides of the backrest frame. Each of the arm supporting frames has an intermediate portion which is connected pivotally to the front end portion of the seat frame, a front leg portion extending downwardly and forwardly from the intermediate portion, and an armrest portion extending upwardly and rearwardly from the intermediate portion. The positioning members are connected respectively and securely to rear end portions of the arm supporting frames. Each of the positioning members is formed with a longitudinal slot which has a horizontal row of upwardly extending positioning portions at the upper side thereof, an access hole, and a restricted passage which communicates the longitudinal slot with the access hole. The positioning studs are secured to and extend outward from the two opposite sides of the backrest frame. Each of the studs engages a selected one of the positioning portions of the longitudinal slot of the corresponding positioning member and consists of a neck and an enlarged head. The neck is sized so as to be slidable from the longitudinal slot through the restricted passage into the access hole. The enlarged head is sized so as to prevent removal of the corresponding stud from the longitudinal slot and so as to be extensible through the access hole when the corresponding neck is moved to the access hole, thereby permitting the stud to separate from the positioning member. Each of the studs is movable so as to engage another one of the positioning portions along the longitudinal slot in order to change the angle between the backrest frame and the seat frame of the seat frame assembly. When the positioning studs are removed from the positioning members, the backrest frame can be folded over the seat frame assembly, while the arm supporting frames can be rotated relative to the seat frame assembly to align two end portions of each of the arm supporting frames with the seat frame assembly.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
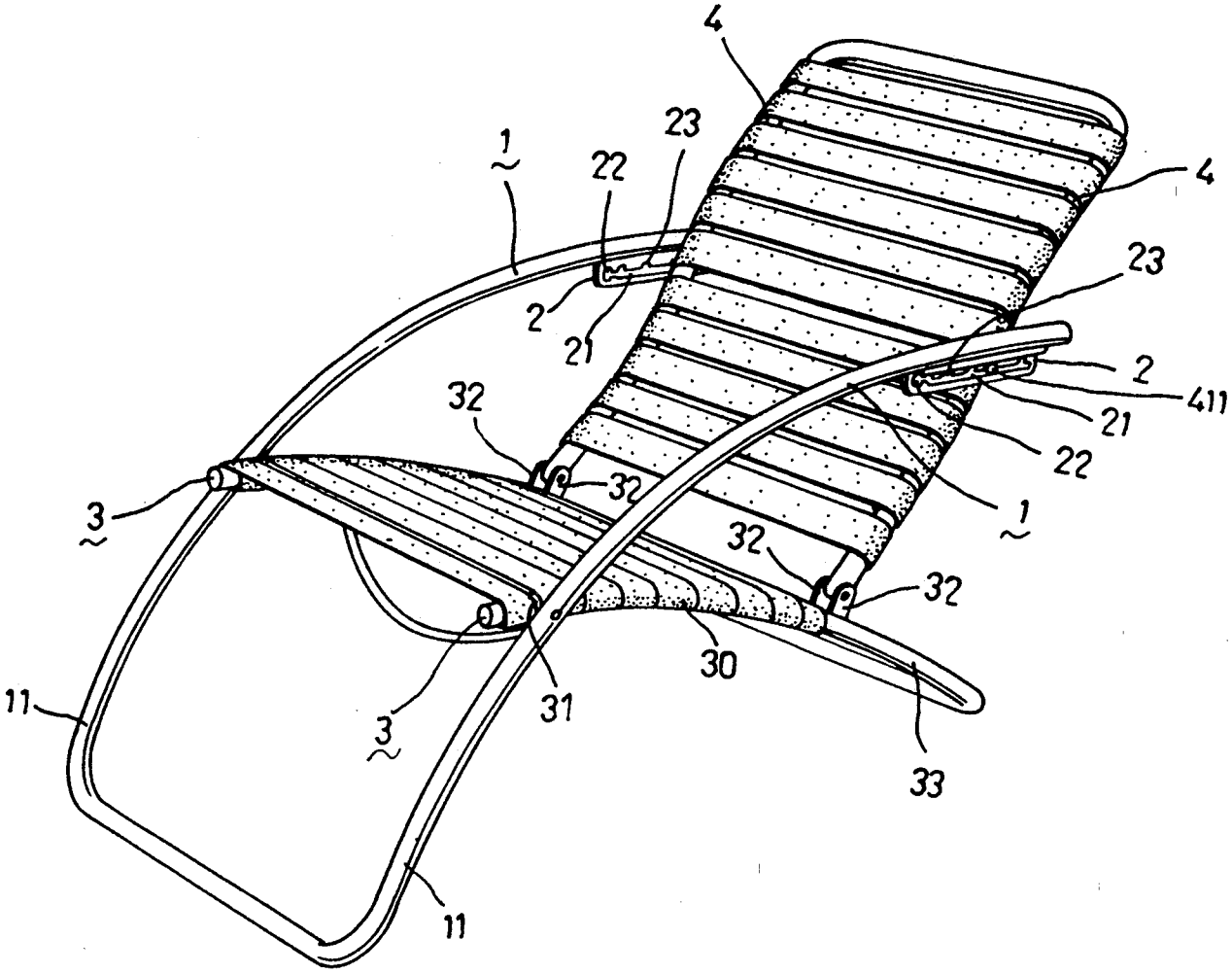
FIG. 1 is a perspective view of a lawn chair according to the present invention.
Figure 2:
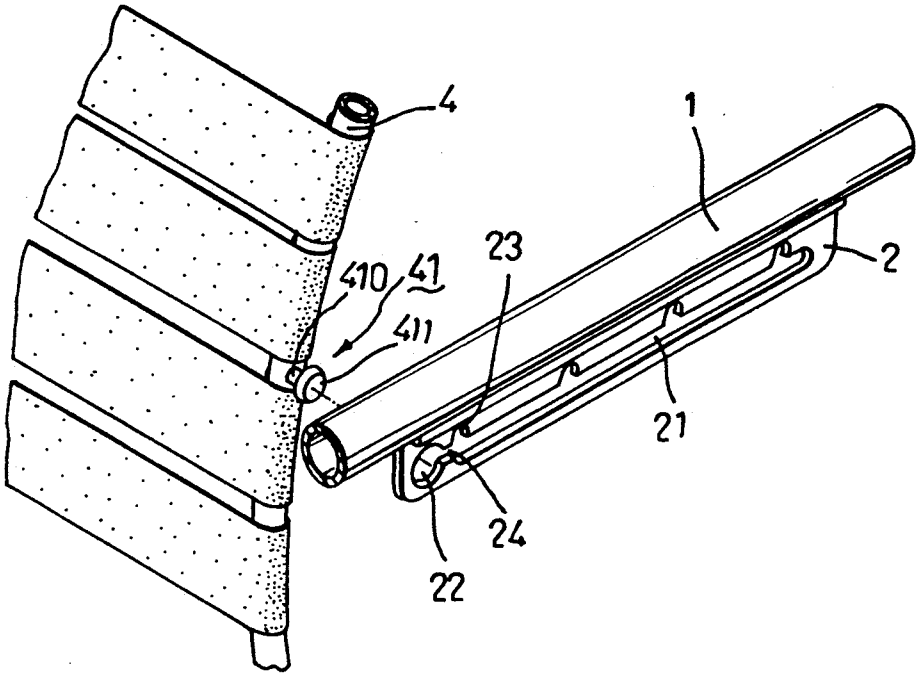
FIG. 2 is an exploded view illustrating one of the positioning members and one of the positioning studs of the lawn chair according to the present invention.

Referring to FIGS. 1 and 2, a lawn chair according to this invention includes a backrest frame (4), a seat frame assembly (3), two spaced arm supporting frames (1), two elongated positioning members (2) and two opposed positioning studs (41).

The seat frame assembly (3) includes a seat frame (30) which has a front end portion (31) and a rear end portion, and a rear leg frame (33) which has an upper end portion formed integrally with the rear end portion of the seat frame (30). A pivot seat unit (32) is provided on the rear end portion of the seat frame (30). The backrest frame (4) is connected pivotally to the pivot seat unit (32) of the seat frame (30) at the lower end portion thereof.

The arm supporting frames (1) are provided on two opposite sides of the backrest frame (4). Each of the arm supporting frames (1) has an intermediate portion which is connected pivotally to the front end portion (31) of the seat frame (30), a front leg portion (11) extending downwardly and forwardly from the intermediate portion, and an armrest portion extending upwardly and rearwardly from the intermediate portion.

The positioning members (2) are connected respectively and securely to the rear end portions of the arm supporting frames (1). Each of the positioning members (2) is formed with a longitudinal slot (21) which has a horizontal row of upwardly extending positioning portions (23) at the upper side thereof, an access hole (22), and a restricted passage (24) which communicates the longitudinal slot (21) with the access hole (22).

The positioning studs (41) are secured to and extend outward from the two opposite sides of the backrest frame (4). Each of the studs (41) is engaged within a selected one of the positioning portions (23) of the longitudinal slot (21) of the corresponding positioning member (2), and consists of a neck (410) and an enlarged head (411). The neck (410) is sized so as to be slidable from the longitudinal slot (21) through the restricted passage (24) into the access hole (22). The enlarged head is sized so as to prevent removal of the corresponding stud from the longitudinal slot and so as to be extensible through the access hole (22) when corresponding neck (410) is moved to the access hole (22), thereby permitting the stud (41) to separate from the positioning member (2). Each of the positioning studs (41) is movable so as to engage another one of the positioning portions (23) along the longitudinal slot (21) in order to change the angle between the backrest frame (4) and the seat frame (30) of the seat frame assembly (3).

Figure 3:
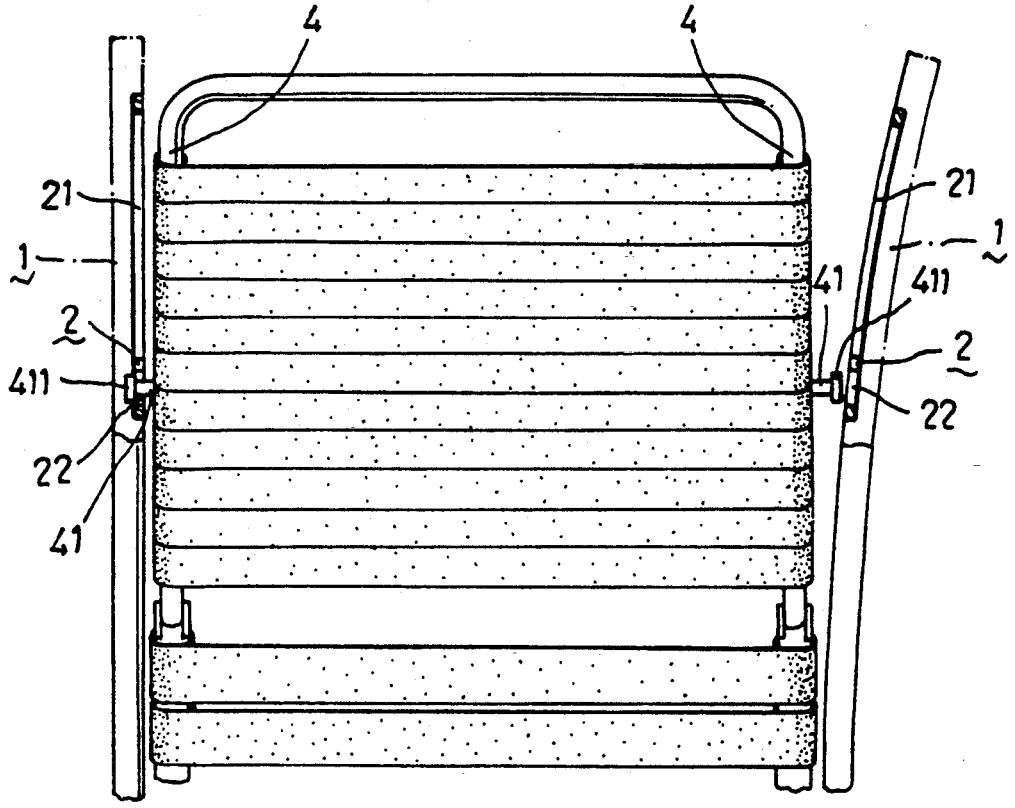
FIG. 3 is a schematic view illustrating the separation of one of the positioning studs from the corresponding positioning member in accordance with this invention.
Figure 4:
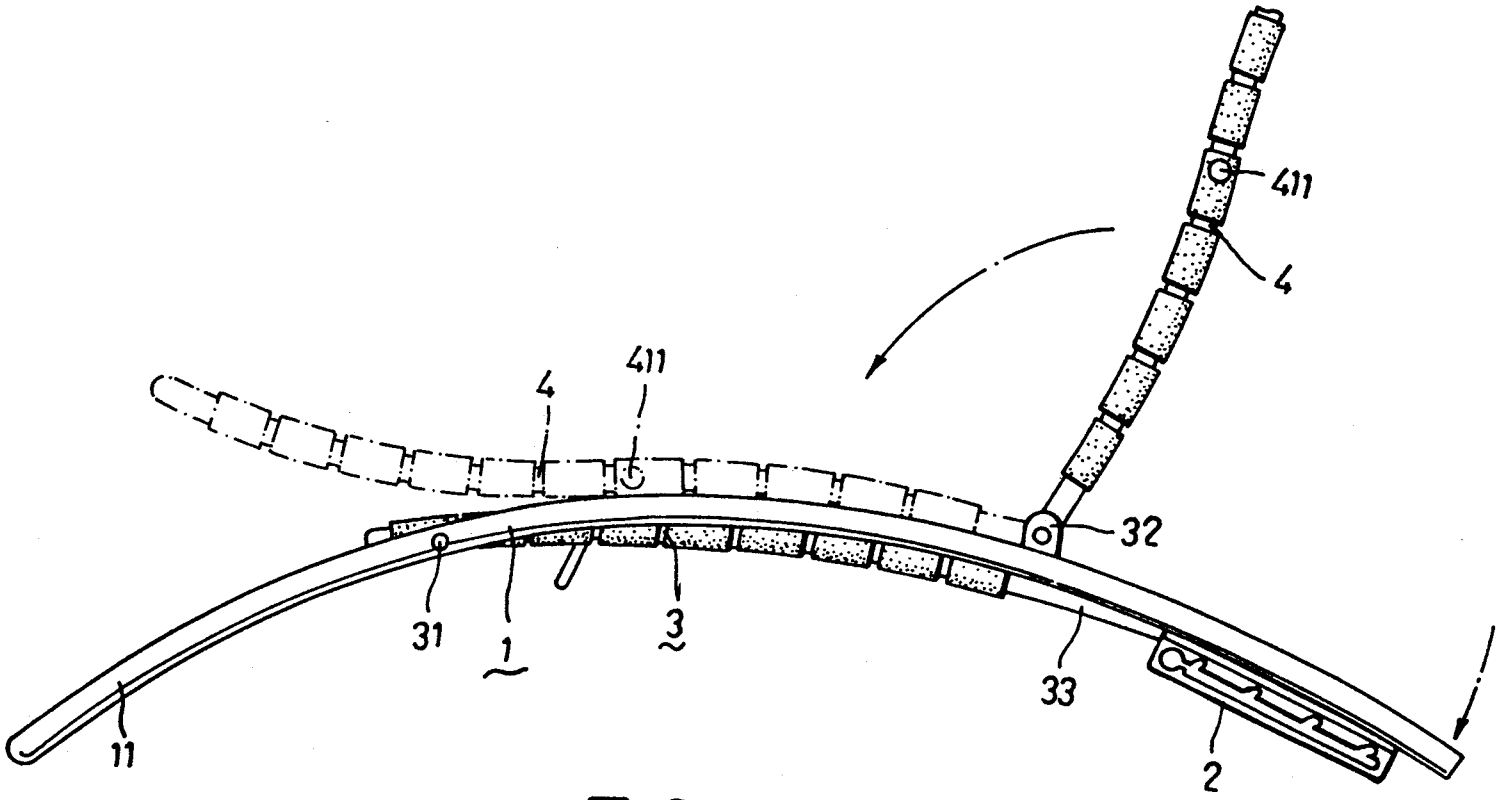
FIG. 4 is a side view showing the folding movement of the backrest frame and the arm supporting frame relative to the seat frame assembly.

Referring to FIGS. 3 and 4, when the necks of the positioning studs (41) disengage from the positioning portions (23) and are slid into the access hole (22), the armrest portion of the arm supporting frame (1) is pulled outwardly so that the enlarged heads (411) can extend through the access hole (22) in order to separate the studs (41) from the positioning members (2). Thus, the backrest frame (4) is permitted to fold over the seat frame assembly (3), while the arm supporting frames (1) are allowed to rotate relative to the seat frame assembly (3) to align two end portions of each of the arm supporting frames (1) with the seat frame assembly (3).

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A lawn chair, comprising:

a backrest frame having a lower end portion;

a seat frame assembly including a seat frame which has a front end portion and a rear end portion, and a rear leg frame which has an upper end portion formed integrally with said rear end portion of said seat frame, said backrest frame being connected pivotally to said rear end portion of said seat frame at said lower end portion thereof;

two spaced arm supporting frames provided on two opposite sides of said backrest frame, each of said arm supporting frames having an intermediate portion which is connected pivotally to said front end portion of said seat frame, a front leg portion extending downwardly and forwardly from said intermediate portion, and an armrest portion extending upwardly and rearwardly from said intermediate portion;

two elongated positioning members connected respectively and securely to rear end portions of said arm supporting frames, each of said positioning members being formed with a longitudinal slot which has a horizontal row of upwardly extending positioning portions at an upper side thereof, an access hole, and a restricted passage which communicates said longitudinal slot with said access hole; and two opposed positioning studs respectively secured to and extending outward from said two opposite sides of said backrest frame, each of said studs being engaged within a selected one of said positioning portions of said longitudinal slot of a corresponding said positioning member and having a neck and an enlarged head, said neck being sized so as to be slidable from said longitudinal slot through said restricted passage into said access hole, said enlarged head being sized so as to prevent removal of said stud from said longitudinal slot and so as to be extensible through said access hole when a corresponding said neck is moved to said access hole, thereby permitting said stud to separate from said positioning member, each of said positioning studs being movable so as to engage another one of said positioning portions along said longitudinal slot in order to change an angle between said backrest frame and said seat frame of said seat frame assembly;

whereby, when said positioning studs are removed from said positioning members, said backrest frame can be folded over said seat frame assembly, while the arm supporting frames can be rotated relative to said seat frame assembly to align two end portions of each of said arm supporting frames with said seat frame assembly.

* * * * *